United States Patent [19]

Thorneloe

[11] Patent Number: 4,969,280

[45] Date of Patent: Nov. 13, 1990

[54] SIDE WING ASSEMBLY

[75] Inventor: Don Thorneloe, Lennoxville, Canada

[73] Assignee: Everest Equipment Inc., Canada

[21] Appl. No.: 393,394

[22] Filed: Aug. 14, 1989

[30] Foreign Application Priority Data

Jul. 31, 1989 [CA] Canada ..... 607136

[51] Int. Cl.[5] ..... E01H 5/06

[52] U.S. Cl. ..... 37/281; 37/105; 37/236

[58] Field of Search ..... 37/232, 234, 236, 279, 37/281, 105

[56] References Cited

U.S. PATENT DOCUMENTS

| | | | |
|---|---|---|---|
| 1,858,212 | 5/1932 | Soule | 37/236 |
| 1,880,984 | 10/1932 | Remington | 37/281 |
| 1,956,007 | 4/1934 | Davin | 37/236 |
| 2,101,666 | 12/1937 | Austin | 37/236 |
| 2,193,532 | 3/1940 | Frink | 37/324 |
| 2,491,797 | 12/1949 | Burns | 37/105 |
| 2,524,329 | 10/1950 | Richardson | 37/236 |
| 2,632,262 | 3/1953 | Whittey | 37/231 |
| 2,643,470 | 6/1953 | Kaeser | 37/105 |
| 2,991,566 | 7/1961 | Sumner et al. | 37/236 X |
| 4,045,892 | 9/1977 | Farrell | 37/236 |
| 4,096,652 | 6/1978 | Raines et al. | 37/232 X |
| 4,357,766 | 11/1982 | Croteau et al. | 37/281 |

FOREIGN PATENT DOCUMENTS

| | | |
|---|---|---|
| 414636 | 8/1943 | Canada . |
| 418113 | 2/1944 | Canada . |
| 514046 | 6/1955 | Canada . |
| 515948 | 8/1955 | Canada . |
| 561587 | 8/1958 | Canada . |
| 609001 | 7/1959 | Canada . |
| 641737 | 5/1962 | Canada . |
| 688625 | 6/1964 | Canada . |
| 692610 | 8/1964 | Canada . |
| 698551 | 11/1964 | Canada . |
| 822884 | 9/1969 | Canada . |
| 822885 | 9/1969 | Canada . |
| 943760 | 3/1974 | Canada . |
| 959258 | 12/1974 | Canada . |
| 967744 | 5/1975 | Canada . |
| 994098 | 8/1976 | Canada . |
| 1046275 | 1/1979 | Canada . |
| 1212540 | 10/1986 | Canada . |

*Primary Examiner*—Randolph A. Reese
*Assistant Examiner*—Arlen L. Olsen
*Attorney, Agent, or Firm*—Larson and Taylor

[57] ABSTRACT

A side wing blade assembly for a vehicle, comprising an elongated blade, an articulated coupling between the front end of the blade and the vehicle, and an articulated attachment system to connect the rear end of the blade to the vehicle. The articulated attachment system includes a pair of vertically spaced apart and generally parallel arms, each of these arms including one end universally mounted to the rear end of the blade and another end universally mounted to the vehicle. A fluid ram having one end connected to the vehicle and another end slidingly engaging one of the arms is used for raising the blade off the ground toward a retracted position. Stops are provided on the arm receiving the fluid ram in order to limit the sliding movement thereon, forcing the fluid ram to act as a dampener as a result of an excessive upward movement of the blade caused by an impact on an obstacle.

10 Claims, 4 Drawing Sheets

SIDE WING ASSEMBLY

FIELD OF THE INVENTION

The present invention relates to the general field of snow removal and, more particularly, to a side wing blade assembly for a snowplow that has superior performance characteristics and also incorporates safety features which make it easily adaptable to light trucks as well as to larger units. This inventive concept is also applicable for graders or other types of equipment for moving granular material such as sand or gravel.

BACKGROUND OF THE INVENTION

Side wing blade assemblies are extensively urged on snowplow vehicles. A typical side wing blade arrangement comprises an elongated curved blade and an articulated attachment system for mounting the blade to the snowplow. More specifically, the mounting system comprises a spring loaded coupling for connecting the front end of the blade to the vehicle, and an articulated hanger unit for connecting the rear end of the blade to the snowplow chassis and also for tilting the wing between a plowing position and a retracted position. In the plowing position, the blade extends at an angle to the longitudinal axis of the vehicle engaging the road surface, while in the retracted position it is lifted up and extends generally parallel and close to the vehicle cabin.

Initially, commercially available side wing blade assemblies were equipped with a cable and sheave system to tilt the blade. This system was progressively abandoned in favour of various types of hydraulically operated devices, due to complexity and high maintenance costs. As a result, the reliability and the performance of side wing blade assemblies have been substantially improved. Still, there is much room for improvement in two other major areas which are those of blade stability during the plowing operation and of blade deflection, the latter phenomenon allowing the blade to yield when it encounters an obstacle. Blade deflection is extremely important when the side wing blade assembly is designed for a lighter truck where the inertial mass of the vehicle is substantially reduced and in absence of adequate blade yielding capability, the vehicle may be seriously damaged when the blade hits an obstacle. It should be appreciated that an unrestricted blade deflection is not desirable either, since the blade may be violently thrown against the vehicle as a result of a strong impact against an obstacle, which may thereby cause substantial body damage.

OBJECT AND STATEMENT OF THE INVENTION

Therefore, an object of the present invention is a side wing blade assembly allowing a good blade stability for an efficient plowing operation and, at the same time, permitting a controlled blade deflection to reduce the risk of damage to the snowplow or to the side wing blade assembly itself, when the blade hits an obstacle.

The invention comprehends a side wing blade assembly for use on a vehicle such as a truck or the like, including an elongated blade extending at an angle with respect to the longitudinal axis of the vehicle, and a mounting system to attach the blade to the vehicle. The mounting system comprises an articulated joint between the front region of the blades and the vehicle, and a rear hanger system including two generally parallel arms, the extremities of each arm being universally mounted to the vehicle and to the wing, respectively. A fluid ram is mounted between the vehicle and one of the arms, slidingly engaging the latter. The sliding motion between the fluid ram and the arm is limited by means of an abutment system to control the sliding motion of the fluid ram on the arm, in turn controlling the blade deflection as it will be explained hereinafter.

In a preferred embodiment, two stops are provided on the arm on which the fluid ram slides, the distance between the stops determining the amount of unrestricted blade deflection allowed. The fluid ram is extended by pumping pressurized operating fluid therein, and as a result, the fluid ram slides on the arm up to one of the abutments. Any further extension of the fluid ram causes the blade to be lifted up and against the vehicle.

When the blade is in the plowing position, close to or engaging the ground surface, the rear end thereof extending away from the vehicle, the fluid ram is retracted. If the blade hits an obstacle, it will move up and toward the vehicle producing a sliding motion between the arm and the fluid ram. The movement of the blade will continue until the fluid ram contacts the other abutment. Further movement of the blade will cause forced extension of the fluid ram which will act as a damper absorbing energy, thus restricting the blade movement.

The sliding connection between the fluid ram and the arm is made by means of a collar mounted on the arm for a translatory motion thereon, the extremity of the piston rod of the fluid ram being connected to the collar. The arm and the collar have rectangular cross-sectional shapes, whereby no rotation of the collar on the arm is allowed. This feature prevents a tendency of the fluid ram to somewhat wrap itself about the arm under the effect of hydraulic pressure when the blade is lifted from the plowing position.

The side wing assembly is particularly advantageous for light trucks because it permits a substantial blade yield toward the vehicle which becomes restricted when the blade passes beyond a certain position. Therefore, road irregularities or small obstacles will result into an unrestricted blade deflection which will not disturb the vehicle movement. In addition, under such normal operating conditions, no extension or retraction of the fluid ram is produced, thus limiting wear of the component. However, if the impact with an obstacle is more violent, greater deflection of the blade will be produced causing an extension of the fluid ram with the resulting dampening effect.

The two generally parallel supporting arms of the blade are also advantageous in that they allow an efficient plowing operation by well stabilizing the blade. With this supporting structure, the blade angle with respect to the road remains generally unchanged even during the upward motion of the blade as a result of road irregularities.

Therefore, the invention comprises, in a general aspect, a side wing blade assembly for use on a vehicle including:

- an elongated blade;
- an articulated connection means on the blade for mounting the front section of the blade to the vehicle;
- means for mounting the rear section of the blade to the vehicle, including:
  - (a) a pair of vertically spaced apart and generally parallel arms, each of the arms including one end universally mounted to the rear section of the blade and another end for universal connection to the vehicle;

(b) a fluid ram slidingly mounted to one of the arms, the fluid ram having an end for connection to the vehicle adjacent the end of the other of the arms for universal connection to the vehicle; and (c) stop means on the arm receiving the fluid ram to limit the sliding movement of the fluid ram thereon.

BRIEF DESCRIPTION OF THE DRAWINGS

For the purpose of illustration, but not of limitation, embodiments of the invention are described hereinbelow with reference to the following drawings in which.

DESCRIPTION OF A PREFERRED EMBODIMENT

Figure 1:
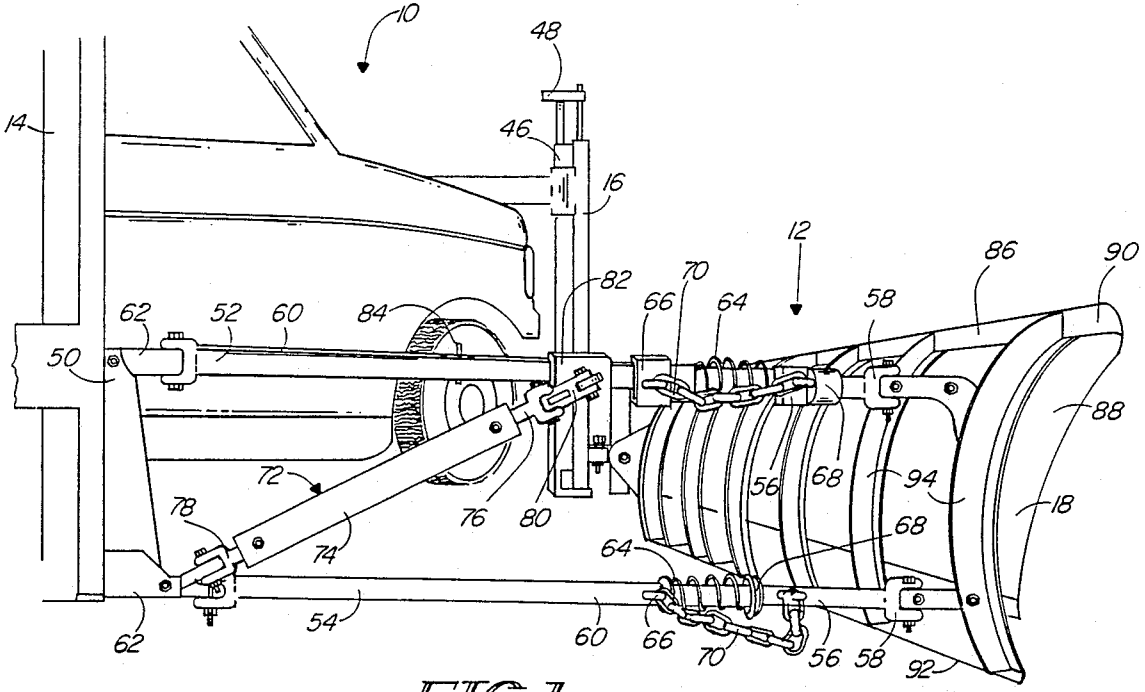
FIG. 1 is a perspective view of a vehicle with a side wing blade assembly, constructed in accordance with the invention, mounted thereto.

Referring now to the annexed drawings, more particularly to FIG. 1, the reference numeral 10 designates in general, a vehicle such as a truck or the like, on which is mounted a side wing blade assembly 12 constructed in accordance with the invention. The side wing blade assembly 12 comprises a supporting frame made of two vertically extending posts 14 and 16 attached to the vehicle chassis in any suitable manner, and used for supporting the front and rear extremities of a blade 18.

Figure 2:
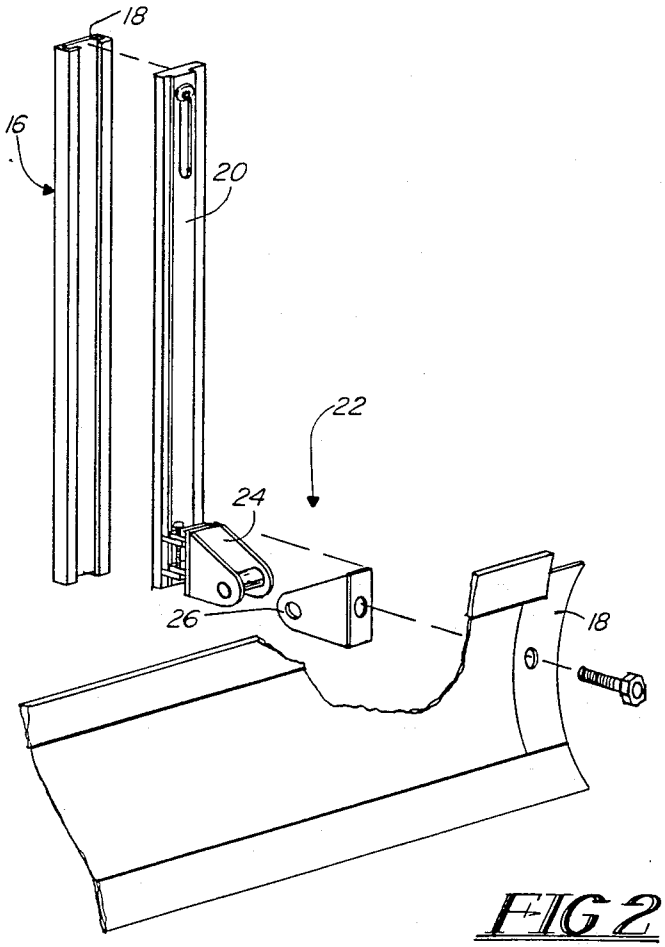
FIG. 2 is an exploded view of an articulated connection for mounting the front end of the blade to the vehicle, some elements being omitted for clarity.
Figure 3:
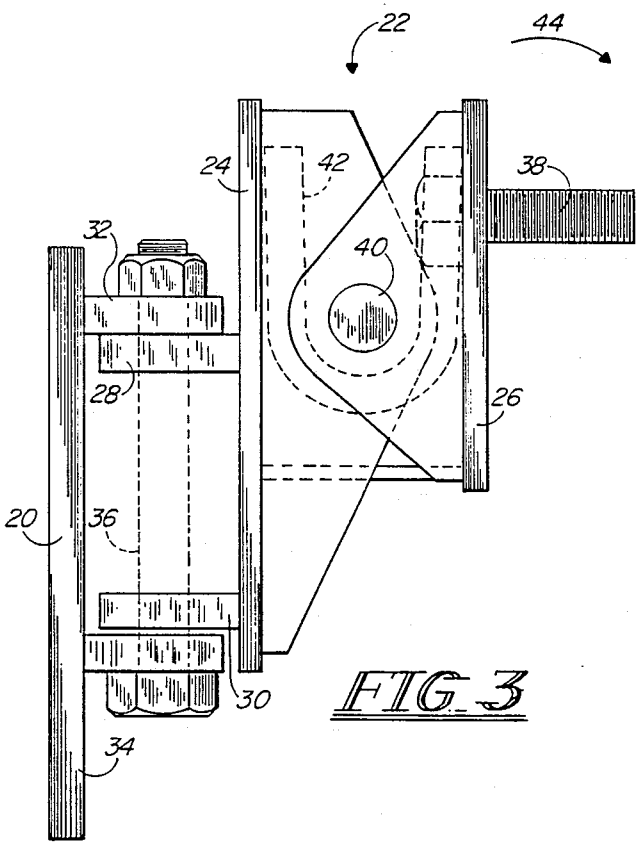
FIG. 3 is an elevational view of the articulated connection shown in FIG. 2.

The front post 16 is illustrated with more detail in FIG. 2. It comprises an elongated channel 18, generally C-shaped in cross-section, made of metallic material having suitable strength characteristics. The channel 18 slidingly receives an elongated slider bar 20 carrying at its lower end a spring loaded universal joint 22 that serves to retain the front end of the blade 18 to the vehicle and also allows a pivotal movement of the blade with respect to the post 16 about two perpendicular axis. More specifically, the universal joint 22 includes mating U-shaped brackets 24 and 26 attached to the bar 20 and the blade 18, respectively. The bracket 24 is provided with vertically spaced flanges 28 and 30 received between similar flanges 32 and 34 on the bar 20 (FIG. 3). The flanges 28 to 34 are drilled to accept a bolt 36 to enable a pivotal movement about a vertical axis between the blade 18 and the bar 20.

The bracket 26 is fixed to the front end of the blade 18 by means of a bolt 38.

The brackets 24 and 26 are retained to each other by means of a horizontally extending pivot pin 40. About the pin 40 and within the brackets 24 and 26 is mounted a coil spring 42 (shown in dashed lines) urging the bracket 26 to pivot in the direction shown by the arrow 44 thereby urging the blade 18 toward a ground engaging position.

Referring back to FIG. 1, the post 16 is also provided with a vertically extending fluid ram 46 connected to the top end of the bar 20 by means of a bracket 48. The purpose of the fluid ram 46 is to raise the blade 18, by the intermediary of the bar 20, in order to adjust the vertical position of the blade.

The post 14 has a structure very similar to the post 16 described above, comprising a carriage 50 mounted to the slider bar instead of the flanges 32 and 34 shown in FIG. 3. From the carriage 50 project laterally two vertically spaced and parallel arms 52 and 54 connected to the rear end of the blade 18. The arms 52 and 54 are substantially longer than the universal joint 22, whereby the blade 18 is oriented at an angle with respect to the longitudinal axis of the vehicle 10 for an efficient plowing operation.

Each one of the arms 52 and 54 includes a first section 56 united to the blade 18 by a universal joint 58 of standard construction, thereby allowing a universal pivotal movement between the arm and the blade but preventing a translational movement therebetween, the first section being telescoped within a longer section 60 whose extremity is connected to the carriage 50 by a universal joint 62 similar to the joint 58. An impact absorbing coil spring 64 is mounted on the first section 56 and extends between abutments 66 and 68 secured on the sections 60 and 56 respectively. The abutments 66 and 68 are in the form of collars welded or otherwise secured to the respective arm sections, however, other means to provide a stop member may also be envisaged, such as pins passing through the arm sections.

A chain 70 unites the abutments 66 and 68 to prevent complete removal of the arm section 56 from section 60.

A fluid ram 72, comprising a cylinder 74 and an extendable piston rod 76, is mounted between the arms 52 and 54. More particularly, the lower end of the cylinder 74 is connected by means of a universal joint 78 to the carriage 50 at a location coinciding with the mounting point of the arm 54 to the carriage 50. With this arrangement, the fluid ram 72 has a good leverage against the arm 52 considering that the lower end of the fluid ram is mounted at a considerable distance relatively speaking with respect to the universal joint 62 of the arm 52. This allows the use of a fluid ram of lesser capacity than if this lower end of the cylinder was mounted to the carriage 50 at mid-point between the arms 52 and 54, and thereby also permits the use of mounting hardware of a smaller capacity.

The extremity of the piston rod 76 is connected through a universal joint 80 to a collar 82 slidingly mounted on the section 60 of the arm 52. The collar 82 and the section 60 have rectangular cross-sectional shapes in order to limit the movement of the collar 82 to that of translation along section 60 while preventing any rotation of collar 82 thereabout. The importance of this feature will become clear as the description proceeds.

Figure 4:
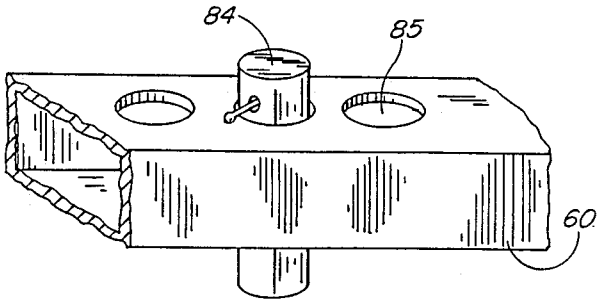
FIG. 4 is a perspective view of a portion of an arm illustrated in FIG. 1, showing an adjustable abutment system on the arm.

The sliding motion of the collar 82 on the section 60 is limited between collar 66 and a stop pin 84 whose position may be adjusted by providing a plurality of pin-receiving holes 85 on the section 60, as best illustrated in FIG. 4, allowing to adjust the range of motion of the collar 82 on the arm 52.

The blade 18 is of a generally conventional construction and for that reason, it will not be described in detail here. Suffice it to say that the blade comprises a reinforcing structure 86 supporting a sheet metal covering 88. The reinforcing structure 86 comprises top and bottom rails 90 and 92 between which extend reinforcing ribs 94 longitudinally spaced along the main axis of the blade 18.

The operation of the side wing blade assembly is as follows.

When desired to bring the blade 18 into a plowing position, the fluid rams at the vertical posts 14 and 16 are fully retracted in order to bring the carriage 50 and the universal joint 22 to the lower extremity of the respective posts, whereby the bottom edge of the blade 18 engages the ground surface. In that position, the fluid ram 72 is fully retracted, as shown in FIG. 1.

When the vehicle advances at a normal operating speed, the blade 18 will move up and down following the ground surface contour and it can also slightly move horizontally, as a result of the compression and expansion of the impact absorbing coil springs 64, limiting the sliding movement between the sections 60 and 56 of the arms 52 and 54. The vertical movement of the blade is allowed, at the rear end thereof, by the universal attachment of the arms 52 and 54 to the carriage 50 and the blade 18 respectively, and at the front end, by the universal joint 22.

As a result of the vertical blade movement, the collar 82 will slide on the arm 52 and its travel movement will be relatively small, the collar 82 remaining at all times away from the stops 66 and 84. In this condition, the fluid ram 72 remains retracted and the blade movement does not produce any forced extension or retraction of the piston rod 76. As a result, the fluid ram 72 will wear out much less rapidly comparatively to a design where the piston rod 76 will be prevented to slide on the arm 52.

When the blade 18 hits an obstacle, it will deflect by moving upwardly and toward the vehicle 10. If the impact is sufficiently strong, the blade 18 will be projected relatively far causing engagement between the collar 82 and the stop 84. Any further upward movement of the blade 18 will result into a forced extension of the fluid ram 72 which will then act as a dampener to absorb energy and preventing the blade 18 to hit the cab of the vehicle 10.

The extent of travel of the collar 82 on the arm 52 is controlled by adjusting the position of the pin 84. For lighter trucks, a lot of travel is preferred in order to prevent small obstacles or road irregularities to disturb its movement, considering that the vehicle is relatively light. In this application, dampening is desired only when the impact is strong enough that the risks of damages to the vehicle or to the side wing assembly itself are present. For heavier trucks, less travel of the collar 82 may be set.

It should be appreciated that the parallel arm arrangement connecting the rear end of the blade 18 to the vehicle 10 allows an exceptional blade stability. More specifically, the angle of the blade 18 with respect to the ground surface remains at all times constant even when the blade deflects upwardly. As a result, a more efficient plowing operation may be achieved.

Figure 5:
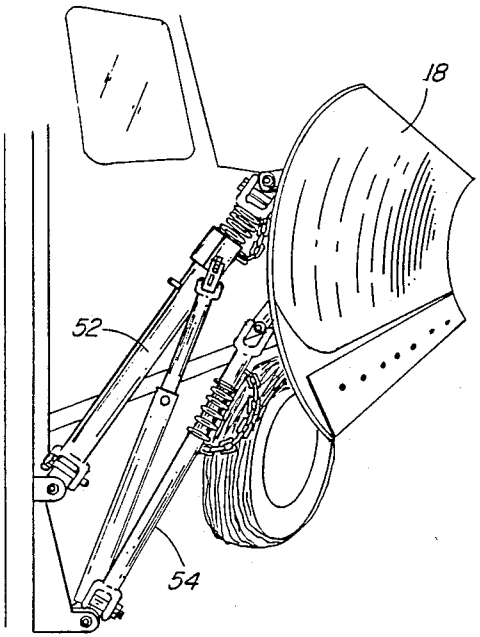
FIG. 5 illustrates the side wing blade assembly in retracted position.

When the blade 18 is to be brought to the retracted position shown in FIG. 5, pressurized fluid is pumped into the fluid ram 72 to extend the piston rod thereof. This extension will slide the collar 82 up to the abutment 66, any further extension of the piston rod will rise the rear end of the blade 18 along a circular trajectory toward the cab of the vehicle 10. Since the collar 82 is not allowed to rotate on the arm 52, the extension of the fluid ram 72 will produce a straight lifting movement, thereby preventing the tendency of the piston rod to somehow wrap around the arm 52 as would be the case if such rotational movement were allowed.

It will, of course, be understood that the present invention has been described above purely by way of example, and those skilled in this art will appreciate that various modifications of detail can be made within the scope of the invention as defined in the appended claims.

I claim:

1. A side wing blade assembly for use on a vehicle, comprising:

an elongated blade;

an articulated connection means on said blade for mounting the front section of said blade to said vehicle;

means for mounting the rear section of said blade to said vehicle including:

(a) a pair of vertically spaced apart and generally parallel arms, namely an upper arm and a lower arm, each of said arms including one end universally mounted to said rear section and another end for universal connection to said vehicle;

(b) a fluid ram mounted to a collar having means for slidingly engaging said upper arm and locking against rotational motion thereon, said fluid ram having an end for connection to said vehicle adjacent the end of said bottom arm for universal connection to said vehicle; and (c) stop means on said upper arm to limit the sliding movement between said fluid ram and said upper arm.

2. A side wing blade assembly as defined in claim 1, wherein said stop means includes first and second abutments at spaced locations on said one of said arms, whereby extension of said fluid ram by pumping fluid therein produces engagement between said fluid ram and said first abutment and movement of said blade toward a retracted position in which said blade extends adjacent said vehicle, and wherein a movement of said blade from an operative position in which said blade extends away from said vehicle at an angle with respect to a longitudinal axis thereof toward said retracted position without assistance of said fluid ram and causing engagement between said fluid ram and said second abutment, results in extension of said fluid ram to thereby restrict the movement of said blade.

3. A side wing blade assembly as defined in claim 2, wherein said stop means is adjustable to vary the maximum travel distance of said fluid ram on said one of said arms.

4. A side wing blade assembly as defined in claim 1, further comprising a collar mounted on said one of said arms, said fluid ram being mounted to said collar.

5. A side wing blade assembly as defined in claim 1, further comprising an articulated attachment means between said arms and said blade allowing for universal pivotal movement of said arms with respect to said blade, said articulated attachment means constituting means to prevent a translational movement between said arms and said blade.

6. A side wing blade assembly as defined in claim 1, further comprising impact absorption means in each of said arms.

7. A side wing blade assembly as defined in claim 6, wherein each of said arms comprises two telescoped sections, and a resilient member therebetween.

8. A side wing blade assembly as defined in claim 7, wherein said resilient member is a coil spring.

9. A side wing blade assembly as defined in claim 1, wherein said collar conforms to a cross-sectional shape of said upper arm which constitutes said engaging and locking means.

10. A side wing blade assembly as defined in claim 9, wherein said cross-sectional shape is rectangular.

* * * * *